US006230331B1

(12) United States Patent
Aguilar et al.

(10) Patent No.: US 6,230,331 B1
(45) Date of Patent: May 15, 2001

(54) HAT WITH APPLICATIONS

(76) Inventors: Gonzalo D. Aguilar, 9310 SW. 137 Ave., #901, Miami, FL (US) 33186; Yordano Vilches, Ave. Leon Velarde, #712 Apt. 207, Lima 14 (PE)

( * ) Notice: Subject to any disclaimer, the term of this patent is extended or adjusted under 35 U.S.C. 154(b) by 0 days.

(21) Appl. No.: 09/518,205

(22) Filed: Mar. 3, 2000

(51) Int. Cl.[7] ..... A42B 1/00
(52) U.S. Cl. ..... 2/209.11; 2/171.1; 2/195.1
(58) Field of Search ..... 2/171, 171.1, 195.1–195.2, 2/209.11–209.12, 209.13; 224/101, 575, 577

(56) References Cited

U.S. PATENT DOCUMENTS 1,869,652 * 8/1932 Baker ..... 2/171
2,007,235 * 7/1935 Woodside ..... 224/575
4,404,689 * 9/1983 DeWan ..... 2/247
5,303,427 * 4/1994 Fishbaine ..... 2/209.11
5,367,713 * 11/1994 McCallum ..... 2/209.12
5,539,929 * 7/1996 Revson ..... 2/195.1
5,845,338 * 12/1998 Clark ..... 2/195.1
5,860,165 * 1/1999 Cvijanovich ..... 2/195.1

* cited by examiner

*Primary Examiner*—John J. Calvert
*Assistant Examiner*—Katherine Moran
(74) *Attorney, Agent, or Firm*—J. Sanchelima

(57) ABSTRACT

A multi-application hat capable of being configured for different functions, such as a handbag, and hat styles. The crown portion includes a removable top member that doubles as a handbag with an internal pocket and a zipper member at its opening. A strap member facilitates its use by permitting a user to carry it over his or her shoulder and a clip permits the removal mounting and unmounting of the top member/handbag to a user's belt. The brim portion is flexible and has cooperative fastening members to bring its edge towards the crown portion for different styles.

4 Claims, 3 Drawing Sheets

HAT WITH APPLICATIONS

BACKGROUND OF THE INVENTION

1. Field of the Invention

The present invention relates to a hat with different applications, and more particularly, to a hat that can be configured in different shapes and additionally utilized as a handbag or be transformed into a waist pouch with various pockets.

2. Description of the Related Art

Many designs for hats have been designed in the past. None of them, however, serve as a multi-application piece. These applications include several hat styles, a handbag and a waist pouch.

SUMMARY OF THE INVENTION

It is one of the main objects of the present invention to provide a multi-application item that may be easily configured in different shapes according to the need of the user at a time.

It is another object of this invention to provide a multi-application item that is confortable for the user to wear.

It is still another object of the present invention to provide a multi-application item that is lightweight yet durable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
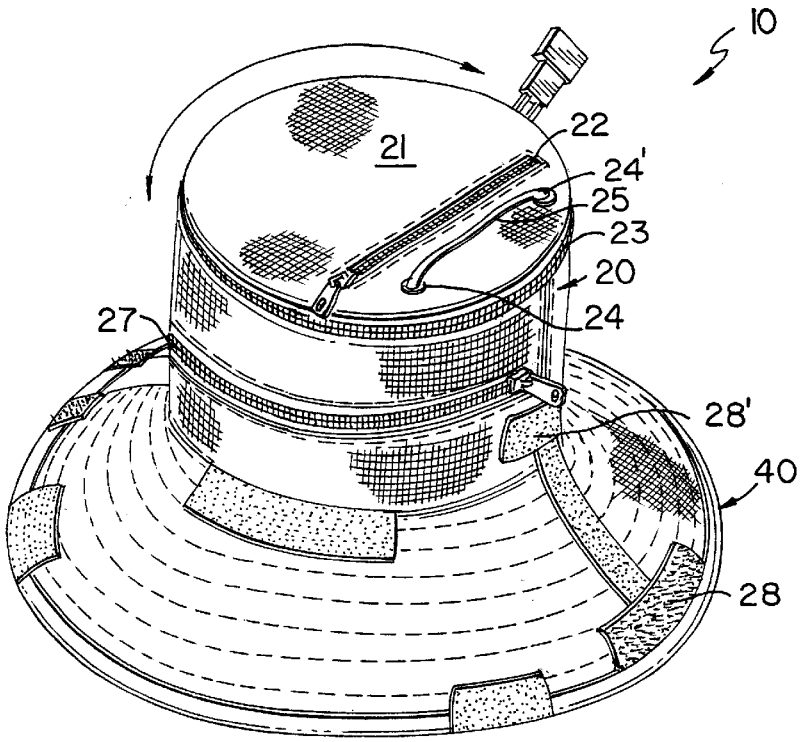
FIG. 1 represents an isometric view of the invention in one of the preferred embodiments configured as a hat.

Referring now to the drawings, where the present invention is generally referred to with numeral 10, it can be observed that it basically includes crown portion 20 and brim portion 40. Different elements in these two portions cooperate with each other to provide flexibility in configuring different shapes of hat 10 for different applications, including a hand bag application.

In FIG. 1, for instance, the present invention is shown in one of the hat configurations. Zipper member 22 at top 21 on one end of crown 20 defines the opening of an internal pocket. Top 21 converts into a handbag, as discussed below.

Figure 2:
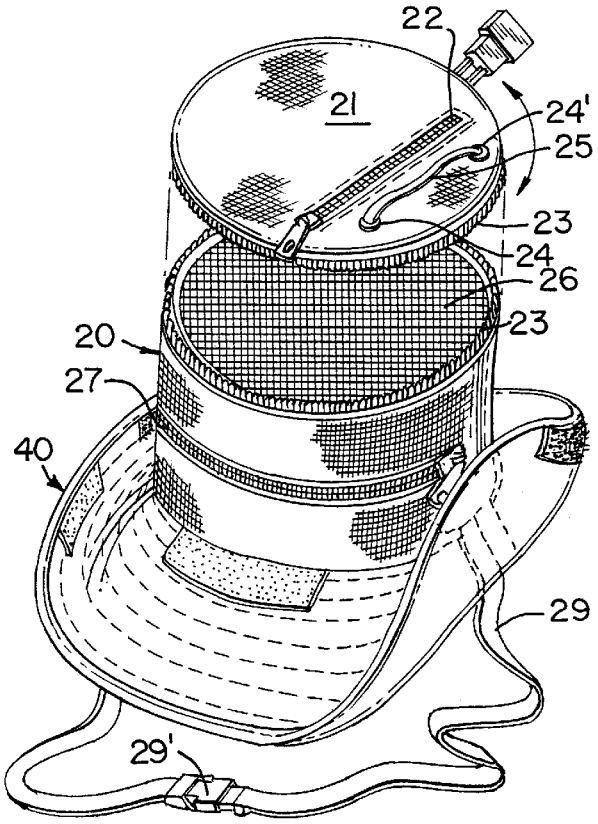
FIG. 2 represents an exploded view of the invention configured as a hat and the top of the crown being detached.

Top peripheral zipper member 23 permits a user to readily attach and detach top 21 as best seen in FIG. 2. An air permeable cloth 26 still provides some protection from the sun to a user, while letting fresh air through. Openings 24 and 24' allow cord or strap member 25 to go through. Central peripheral zipper member 27 is positioned centrally on the lateral wall of crown portion 40 and a predetermined distance away from top 21. The edge of crown portion 40 can be selectively folded towards crown portion 20 and kept in place with cooperative Velcro pads 28 and 28', as seen in FIGS. 1 and 2, for another hat configuration. Chin strap 29 includes buckle member 29'.

Figure 3:
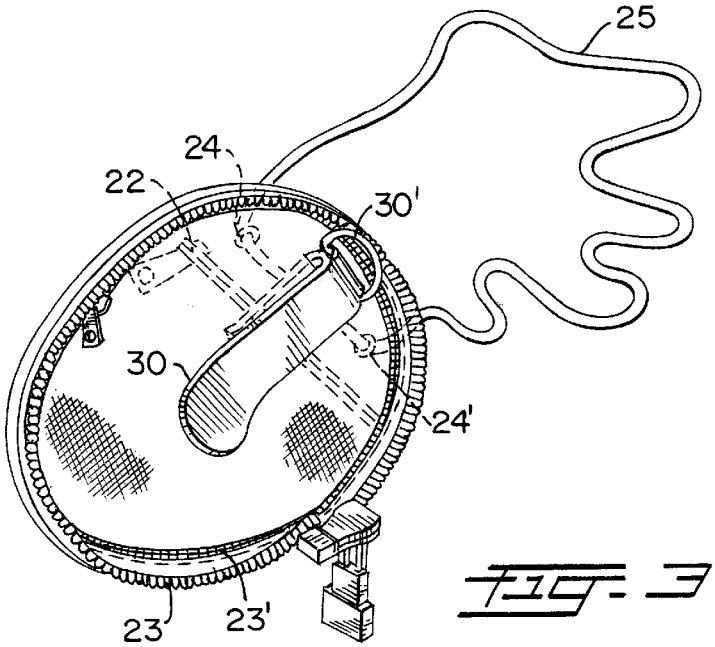
FIG. 3 is a representation of another configuration for the present invention as a handbag.

In FIG. 3 we can see the inner side of top 21, detached from crown portion 40, with zipper member 22 shown in phantom. Zipper member 23, defining the outer edge of top 21 and zipper member 23' defines the opening of an internal pocket. Clip assembly 30 is shown in this figure. It is intended to be used on a user's belt. Loop 30' can also be used to hang top 21.

A user may use hat 10 in different configurations. The basic configuration is shown in FIG. 1 and another configuration is shown in FIG. 2 with a section of crown portion 40 folded back. Other configurations include a rapper hat style, jockey style, priest style, Australian style, sailor style, Deutsche style, tropical style, sleeper style, wings style, oriental style, and Moskovitz.

Figure 4:
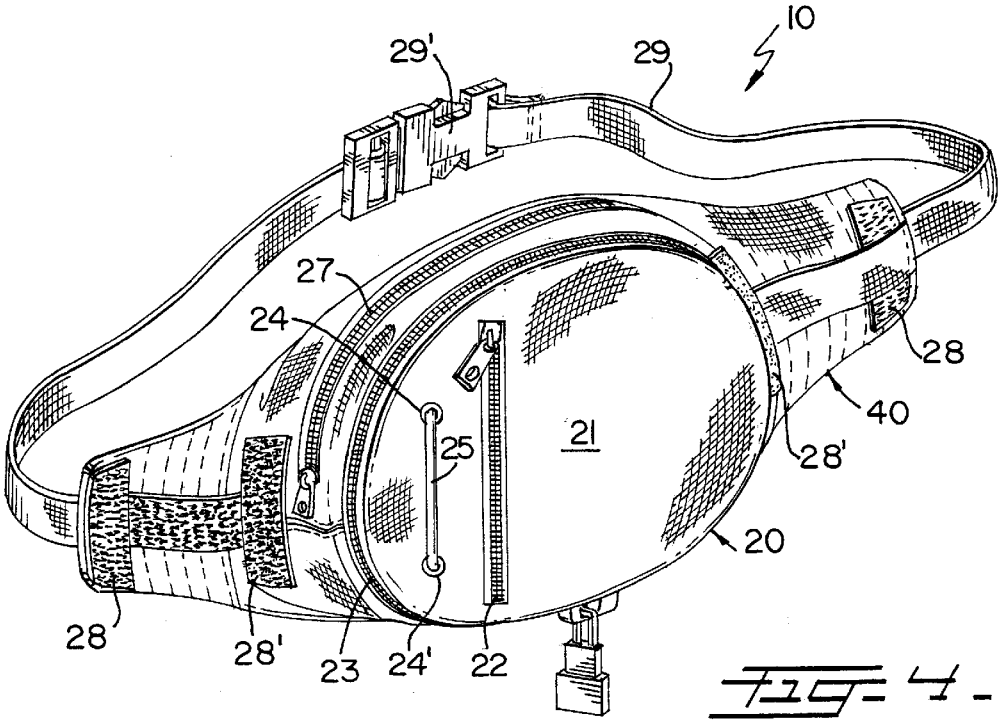
FIG. 4 illustrates the hat when it is used as waist pouch.

FIG. 4 illustrates the present invention in a waist pouch configuration. Chin strap 29 is utilized by the user around the waist area. Buckle member 29' secures chin strap 29 around the waist of the user.

Figure 5:
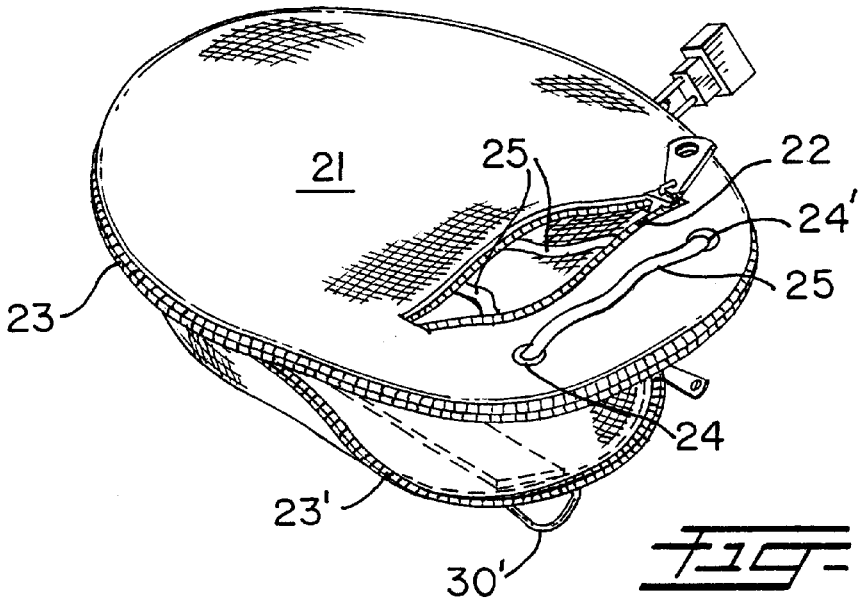
FIG. 5 is a representation of another configuration for the present invention.

FIG. 5 illustrates the outer side of top 21, detached from crown portion 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hat, comprising:

A) a crown portion having first and second ends and a substantially cylindrical shape with a lateral wall and a removable top member mounted at said first end, said top member including first and second sides and said first side includes a first zipper member defining an opening and an internal pocket member and said top member further includes a strap member attached thereto wherein said top member includes a clip assembly on said second side so that a user can readily mount and unmount said top member to his or her belt; and B) a flexible brim portion integral to said crown portion.

2. The hat set forth in claim 1 wherein said top member includes a second zipper member for removably mounting and unmounting said top member to said first end.

3. The hat set forth in claim 2 wherein said crown portion includes an air permeable cloth mounted adjacent to said first end so that a user is protected from the sunlight when said top member is removed.

4. The hat set forth in claim 3 wherein said brim portion and said lateral wall include a plurality of cooperatively positioned fastening means for keeping said brim portion in different positions relative to said lateral wall.

* * * * *